US007061172B2

(12) United States Patent
Jung

(10) Patent No.: US 7,061,172 B2
(45) **Date of Patent: *Jun. 13, 2006**

(54) CATHODE RAY TUBE HAVING IMPROVED STRUCTURE OF A FLAT PANEL

(75) Inventor: Sung Han Jung, Gumi-si (KR)

(73) Assignee: LG.Philips Displays Korea Co., Ltd., Gyeongsangbuk-do (KR)

( * ) Notice: Subject to any disclaimer, the term of this patent is extended or adjusted under 35 U.S.C. 154(b) by 247 days.

This patent is subject to a terminal disclaimer.

(21) Appl. No.: 10/265,585

(22) Filed: Oct. 8, 2002

(65) Prior Publication Data

US 2004/0000860 A1 Jan. 1, 2004

(30) Foreign Application Priority Data

Jun. 26, 2002 (KR) ..... 2002-36019

(51) Int. Cl.
*H01J 29/10* (2006.01)
*H01J 29/07* (2006.01)

(52) U.S. Cl. ..... 313/477 R; 313/402; 313/408; 313/461; 313/474; 220/2.1 R; 220/2.1 A; 220/2.3 R; 220/2.3 A

(58) Field of Classification Search ..... 313/477 R, 313/402; 220/2.1 R, 2.1 A, 2.3 R, 2.3 A
See application file for complete search history.

(56) References Cited

U.S. PATENT DOCUMENTS 5,236,522 A 8/1993 Fukuda et al.
6,236,150 B1 * 5/2001 Park ..... 313/402
6,274,977 B1 * 8/2001 Pyun et al. ..... 313/477 R
6,337,535 B1 * 1/2002 Kim ..... 313/461
6,459,196 B1 * 10/2002 Cho et al. ..... 313/477 R (Continued)

FOREIGN PATENT DOCUMENTS

JP 10219397 A * 8/1998

OTHER PUBLICATIONS

English language translation of the abstract for Korean Patent Document KP 1998-0011926 (Publication No. 1998-081086).

(Continued)

*Primary Examiner*—Kavrabi Guharay
*Assistant Examiner*—Sikha Roy
(74) *Attorney, Agent, or Firm*—Birch, Stewart, Kolasch & Birch, LLP

(57) ABSTRACT

A flat color cathode ray tube having excellent doming quality is obtained by improving the structure of a flat panel and by using a shadow mask made of AK (aluminum-killed) material. According to the cathode ray tube, an outer surface of a panel used for the cathode ray tube is substantially flat, and an inner surface thereof has a curvature, and a transmittance ratio of ending portion of an effective surface to central portion of the panel is in the range of 0.4 to 0.6, and the radius of diagonal curvature (Rd) of the inner surface of the panel is in the range of 1.29R to 4.35R (R=1.767× diagonal length of effective surface), and a shadow mask is made of AK material. The cathode ray tube embodying the principles of the present invention is very advantageous in that it has a price as low as half the price of the conventional cathode ray tube, yet its panel uses a shadow mask made of AK material which has a doming quality equivalent to that of a shadow mask made of Invar material.

19 Claims, 3 Drawing Sheets

U.S. PATENT DOCUMENTS

| | | | | |
|---|---|---|---|---|
| 6,555,951 | B1 * | 4/2003 | Jeoung | 313/408 |
| 6,628,062 | B1 * | 9/2003 | Nah et al. | 313/477 R |
| 6,677,702 | B1 * | 1/2004 | Kim et al. | 313/477 R |
| 2002/0017869 | A1 | 2/2002 | Shimizu et al. | |

OTHER PUBLICATIONS

CN 1278652 published Jan. 3, 2001—corresponding English abstract of EP1061548.

* cited by examiner

CATHODE RAY TUBE HAVING IMPROVED STRUCTURE OF A FLAT PANEL

BACKGROUND OF THE INVENTION

1. Field of the Invention

The present invention generally relates to a flat color cathode ray tube, and in particular, to a flat color cathode ray tube with excellent doming quality by improving the structure of a flat panel and by using a shadow mask made of AK (aluminum-killed) material.

2. Description of the Related Art

FIG. 1 is a diagram explaining the structure of an already-known color cathode ray tube.

Referring to FIG. 1, the conventional color cathode ray tube includes a front side glass panel 1, and a rear side glass funnel 2 that is jointed with the panel 1. The panel 1 and the funnel 2 are sealed together in a manner such that their insides are under vacuum, forming a vacuum tube.

A fluorescent screen 13 is formed on the inner side of the panel 1, and an electron gun 8 is mounted in a neck portion of the funnel 2 that opposes the fluorescent screen 13.

A shadow mask 3 for dividing three color electron beams emitted from the electron gun 8, spaced at a given distance away from the fluorescent screen 13. The shadow mask 3 is combined with a mask frame 4, and is elastically supported by a spring 5, and further by the panel 1 with a stud pin 5.

The mask frame 4 is jointed with an inner shield 7 that is made of a magnetic material to reduce any movement of electron beam 11 due to an external magnetic field, particularly from the rear side of the cathode ray tube (or Braun tube).

On the other hand, a convergence purity magnet (CPM) 10 for adjusting R, G, and B electron beams to converge on a point, and a deflection yoke 9 for deflecting the electron beam 11 are mounted on a neck portion of the funnel 2.

Also, a reinforcing band 12 is included to reinforce the front surface glass in order to offset the influence of a vacuum state of the tube.

To explain the operation of a thusly constructed color cathode ray tube, the electron beams 11 emitted from the electron gun 8 are deflected vertically and horizontally by the deflection yoke 9, and the deflected electron beams 11 pass through beam pass holes in the shadow mask 3, and strike the fluorescent screen 13 on the front, consequently displaying designated color images.

Here, the convergence purity magnet 10 compensates the convergence and purity of R, G, and B electron beams 11, and the inner shield 7 blocks the influence of the magnetic field from the rear side of the cathode ray tube.

FIG. 2 is a diagrammatic view explaining a conventional panel and a flat panel.

As depicted in the drawings, FIG. 2*a* shows a panel, the outside surface of which is substantially flat and the inside surface thereof is has a curvature, while FIG. 2*b* shows a panel, the outside and inside surfaces of which are all curved.

It has been believed that the panel 1 of the cathode ray tube, on which images are displayed, should be curved both inside and outside in order to withstand the high vacuum state of the inside of the cathode ray tube, and to make the electron beams land easily.

However, external light is severely reflected on the peripheral side rather than at the center of the panel 1 in terms of the incidence angle of the external light, and this consequently makes users see very distorted images on the peripheral side. For such reason, the flat type panel 1 has drawn a lot of interests and in fact, most of panels 1 currently being used tend to be flat as shown in FIG. 2*a*.

Korean Patent Laid-Open No. 0282536 discloses a panel in which the outer surface is flat and the inner surface is curved.

As illustrated in FIG. 2*a*, as for the flat color cathode ray tube including a panel having a flat outer surface and curved inner surface and a frame mask, a shadow mask is further provided as a dichroic means, receiving tension to minimize deterioration of picture quality that often occurs due to a doming phenomenon of the shadow mask.

Keeping abreast of such trend, the curvature of the shadow mask in the panel 1 is also becoming flat similar to that of the panel's inner surface. The panel's inner surface is curved in connection with the dichroic function for images, while the shadow mask is curved for more convenient landing that determines convergence for converging R, G, and B electron beams to one point by deflection and color purity of images.

However, as the inner surface of the shadow mask became flatter, doming, which is thermal deformation of the shadow mask due to the electron beam, became a problem. To solve the problem, a shadow mask made of invar material having a relatively low coefficient of thermal expansion was introduced.

Unfortunately though, a shadow mask made of invar is too expensive, thus increasing the overall production cost.

SUMMARY OF THE INVENTION

It is, therefore, an object of the present invention to provide a flat color cathode ray tube which can address the effect doming on quality by improving the structure of a flat panel and by using a shadow mask made of AK (aluminum-killed) material.

Another object of the present invention is to provide a cathode ray tube whose transmittance ratio of the peripheral side to the central part is 0.4 to 0.6; thereby increasing the contrast and consequently picture quality, and whose curvature radius of the panel inner surface is changed to 1.29R to 4.35R, thereby reinforcing the doming characteristics and decreasing the curvature radius of the mask, and whose material of manufacture is AK, which has a relatively greater thermal expansivity than the thermal expansivity that of the conventional Invar mask and has a cost as low as half the price of the conventional cathode ray tube despite its poor doming characteristics.

Still another object of the present invention is to secure price competitiveness and to improve productivity by using a shadow mask made of lower priced AK material.

To achieve the above objects, there is provided a cathode ray tube, wherein an outer surface of a panel is substantially flat and an inner surface of the panel has a curvature, and the transmittance of the effective surface's ending portion in contraction with the central portion of the panel is in the range of 0.4 to 0.6, and the radius of diagonal curvature (Rd) of the panel's inner surface is in the range of 1.29R to 4.35R (R=1.767×diagonal length of the effective surface), and a shadow mask is made of AK material.

The cathode ray tube embodying the principles of the present invention is made of AK material, has a flat outer surface, which can minimize distortion of the screen and reproduces idealistic images, and has 5 an inner surface with a curvature, which can prevent deterioration of the picture quality due to the doming phenomenon of a shadow mask.

In addition, the cathode ray tube of the present invention has a price as low as half the price of the conventional panel, and uses the shadow mask made of AK material yet manifesting equivalent doming quality to that of the shadow mask made of Invar material.

Therefore, the cathode ray tube according to the present invention is advantageous in terms of price competitiveness and productivity because it uses a shadow mask made of low-price AK material.

BRIEF DESCRIPTION OF THE DRAWINGS

The above objects, features and advantages of the present invention will become more apparent from the following detailed description when taken in conjunction with the accompanying drawings, in which.

DETAILED DESCRIPTION OF THE PREFERRED EMBODIMENT

Figure 1:
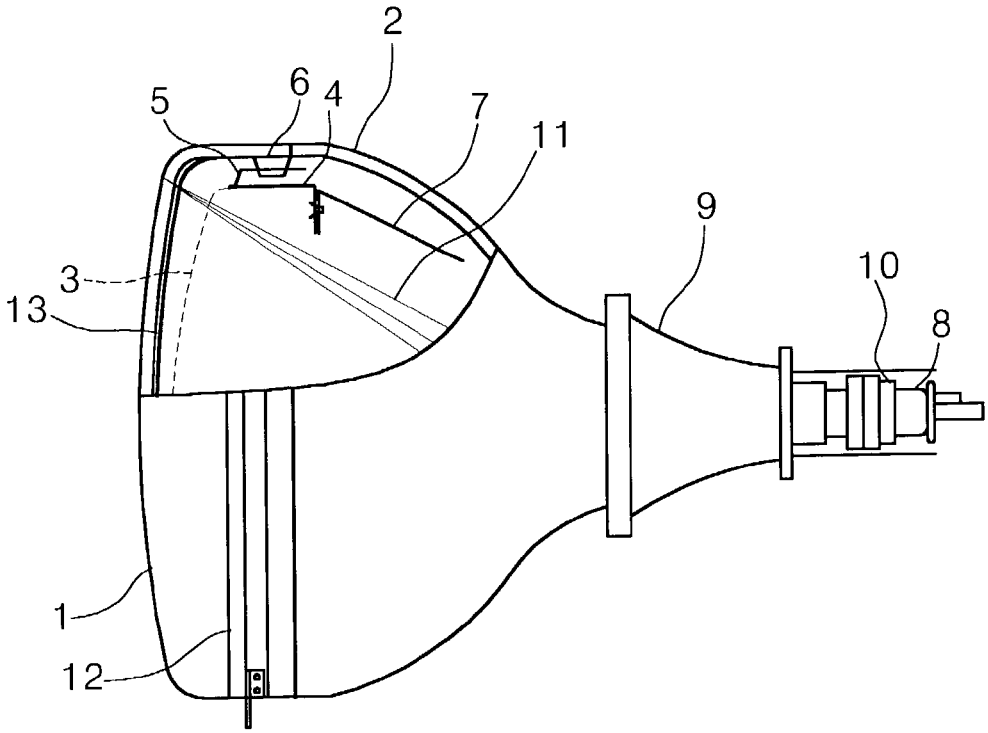
FIG. 1 (Related art)
FIG. 1 is a schematic diagram of a color cathode ray tube according to the related art.
Figure 2:
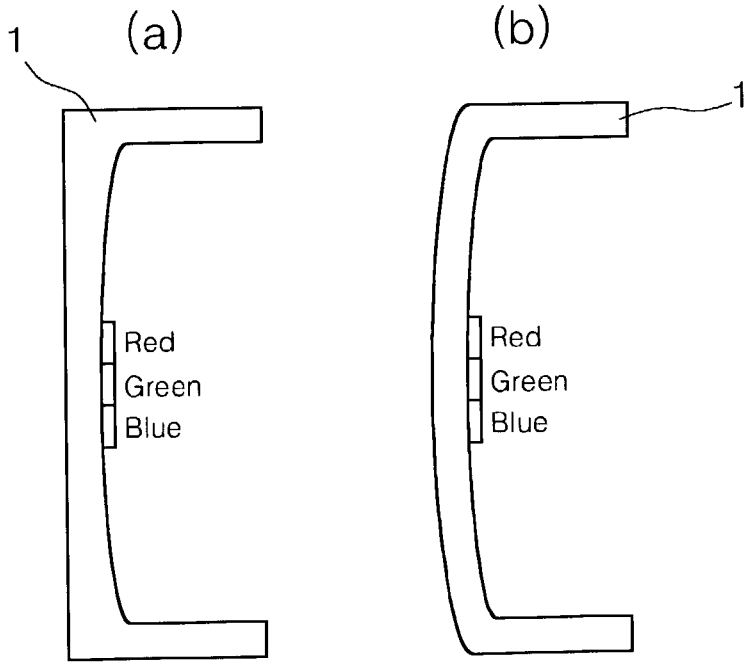
FIG. 2 (Related art)
FIG. 2 is a diagram explaining a general panel and a flat panel according to the related art.

A preferred embodiment of the present invention will be described herein below with reference to the accompanying drawings. In the following description, well-known functions or constructions are not described in detail since they would obscure the invention in Unnecessary detail.

Normally, AK material indicates a material having Fe as a main component and a small amount of other components as shown in Table 1. The coefficient of thermal expansion of the AK material is in the range of 8 to $20\times10^{-6}$, that is, its deformation due to heat is 5.3 to 13.3 times the deformation due to heat of Invar material.

The comparison result of Invar material and AK material is provided in Table 1 below.

TABLE 1

| Raw Material | Price | Doming | Etch-ability | Plas-ticity | Main Com-ponent | Coefficient of Thermal Expansion |
|---|---|---|---|---|---|---|
| Invar material | High-price | Good | Bad | Bad | Fe: 60–4%, Ni: 35–36% | $1.5\times10^{-6}$ |
| AK material | Low-price | Bad | Good | Good | Fe: 99.7%–99.0% | $8–20\times10^{-6}$/ |

As shown in Table 1, the shadow mask made of AK material, compared to the shadow mask made of Invar material has relatively good price, etchability, and plasticity, but it is weak at the doming phenomenon compared to the shadow mask made of Invar material because of its large coefficient of thermal expansion. As an attempt to solve the problem, some researchers tried to reduce the radius of curvature of the shadow mask made of AK material.

Unfortunately however, the curvature of the shadow mask is very closely related to the curvature of the panel's inner surface, so the radius of curvature of the shadow mask cannot be reduced indefinitely.

More specifically, if the radius of curvature of the shadow mask is reduced, the radius of curvature of the panel's inner surface should be reduced as well because when the peripheral portion is thicker than the central portion of the panel more than a fixed limit, the transmittance of the panel's peripheral portion gets decreased, which consequently lowers the brightness of the panel's peripheral portion.

Table 2 explains ratio of the transmittance at the corner to the transmittance at the center, radius of diagonal curvature, Td/Tc, Rd/(USD/2), according to the size of the panel.

TABLE 2

| | Length: Breadth | Corner/Center Transmittance | Radius of Diagonal Curvature | Td/Tc | Rd/(USD/2) |
|---|---|---|---|---|---|
| 15-inch | 4:3 | 0.6 | 2.30R* | 2.10 | 8.11 |
| 15-inch | 4:3 | 0.4 | 1.29R | 2.30 | 4.55 |
| 21-inch | 4:3 | 0.6 | 3.27R | 2.05 | 9.79 |
| 21-inch | 4:3 | 0.4 | 1.83R | 2.45 | 6.45 |
| 25-inch | 4:3 | 0.6 | 3.80R | 2.04 | 9.86 |
| 25-inch | 4:3 | 0.4 | 2.12R | 2.42 | 7.48 |
| 29-inch | 4:3 | 0.6 | 4.35R | 2.09 | 10.68 |
| 29-inch | 4:3 | 0.4 | 2.42R | 2.50 | 8.54 |
| 28-inch | 16:9 | 0.6 | 4.25R | 2.04 | 10.10 |
| 28-inch | 16:9 | 0.4 | 2.37R | 2.45 | 8.81 |
| 32-inch | 16:9 | 0.6 | 4.25R | 2.07 | 9.74 |
| 32-inch | 16:9 | 0.4 | 2.25R | 2.50 | 7.27 |

*1R = 1.767 × Diagonal length of effective surface

Figure 3:
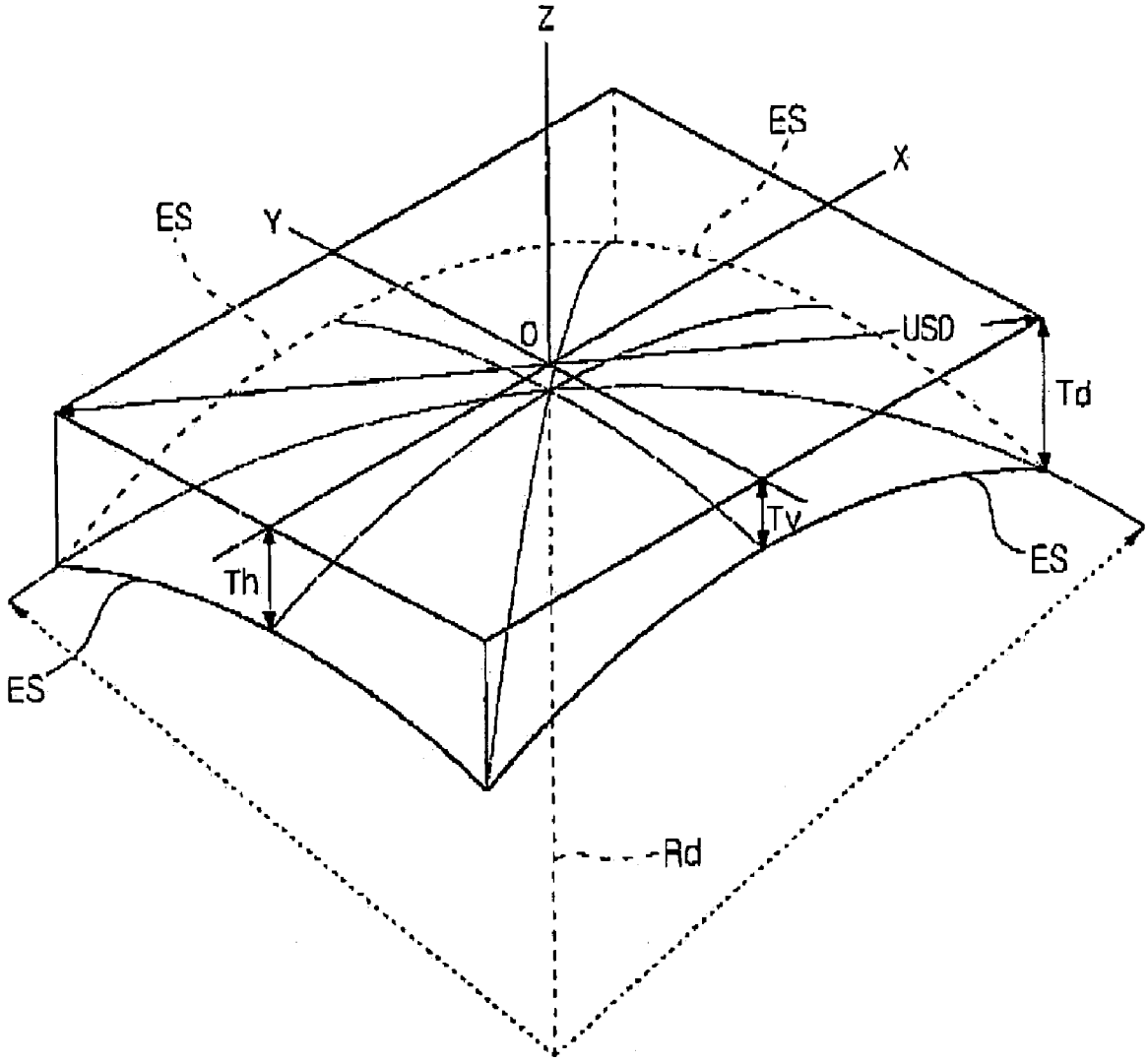
FIG. 3 is a diagram explaining thickness, length, and curvature of each part of a cathode ray tube according to the present invention.

With reference to Table 2, and FIG. 3, Tc is thickness of the panel's central portion, and Td is thickness of the panel's diagonal portion. The edges of the effective surface are designated by ES, and the surface area within those edges is the effective surface.

Also, Rd is radius of diagonal curvature of the panel's inner surface, and USD is diagonal length of the panel.

Referring to Table 2, as for the flat Braun tube having a flat outer surface and a curved inner surface, and using the shadow mask made of AK material, if the corner/center transmittance is below 0.4, the brightness at the peripheral portion gets so low that proper images cannot be reproduced. The panel's peripheral portion is very thick, and heavier thereby lowering productivity and increasing costs.

On the other hand, if the corner/center transmittance is higher than 0.6, the curvature is such that it cannot deal with the doming phenomenon by using the shadow mask made of AK material, and at the same time, the shadow mask becomes very weak, causing a problem such as a howling phenomenon or dropping the quality overall.

Further, if the radius of diagonal curvature is greater than 4.35R, a sufficient curvature for use of the shadow mask made of AK material cannot be formed, which consequently deteriorates the picture quality due to the doming phenomenon, and the thickened central portion of the panel for strengthening against the effect of high vacuum, instead lowers the brightness.

In the meantime, if the radius of diagonal curvature is lower than 1.29R, it makes the panel's corner too thick, and as a result, productivity is lowered and price is increased and an internal path is very easily damaged during the manufacturing process.

Therefore, it is preferable to have the corner/center transmittance between 0.4 and 0.6, and the radius of diagonal curvature between 1.29R and 4.35R.

Next, in case that Td/Tc is below 2.04, a sufficient curvature for use of the shadow mask made of AK material cannot be formed, which consequently deteriorates the picture quality due to the doming phenomenon, and lowers the landing and color purity overall because of too big of a gap between the panel and the shadow mask.

Meanwhile, if Td/Tc is greater than 2.50, images on the flat Braun tube become severely distorted, and the peripheral portion gets dark because the diagonal ending portions of the panel are too thick.

Although such problems may be overcome by using a clear panel whose transmittance at the center portion is higher than 80%, but the panel's outer surface must be coated to effect better brightness of images, thus incurring additional cost.

Accordingly, it is preferable to have Td/Tc in the range of 2.04 to 2.50.

Moreover, if Rd/(USD/2) is below 4.55, although the picture quality is not deteriorated due to the doming phenomenon, the diagonal ending portions of the panel become too thick, which consequently lowers the panel's plasticity, and increases image distortion. Further, the increased weight lowers productivity and increases manufacturing cost as well.

On the other hand, if Rd/(USD/2) is higher than 10.68, the central portion of the panel must be increased in order to secure the strength due to high vacuum, but it lowers the brightness instead.

Therefore, it is preferable to have Rd/(USD/2) in the range of 4.55 to 10.68.

Lastly, suppose that the transmittance at the central portion of the panel is 40–75%. If the radius of diagonal curvature in this case is greater than 4.35R, the resultant curvature is not sufficient for using the shadow mask made of AK material, eventually lowering picture quality due to the doming phenomenon. The thickened central portion of the panel to obtain strength due to high vacuum lowers brightness.

However, if the radius of diagonal curvature is below 1.29R (again, the transmittance at the central portion of the panel is 40–75%), it makes the panel's corner too thick. As the result thereof productivity is lowered and price is increased and an internal path is very easily damaged during the manufacturing process.

In short, if the transmittance at the central portion of the panel is 40–75%, it is preferable to have the radius of diagonal curvature in the range of 1.29R to 4.35R.

Table 3 below explains an embodiment to which 21-inch Braun tube is applied.

TABLE 3

| Property | AK + 3.4 R | AK + 2.8 R | AK + 2.3 R | AK + 1.5 R |
|---|---|---|---|---|
| Local Doming | 90 μm | 84 μm | 70 μm | 60 μm |
| Doming | 95 μm | 67 μm | 57 μm | 45 μm |
| Drop | 23 G | 27 G | 33 G | 40 G |

As manifested in Table 3, by using the shadow mask made of AK material and having the radius of diagonal curvature of the panel changed from 3.4R to 1.5R, the local doming, doming, and drop characteristics (breakage under force of a drop test) were greatly improved.

Table 4 shows the ratio of thickness toward every direction.

TABLE 4

| | Tv/Td | Th/Td | Th/Tc | Tv/Tc |
|---|---|---|---|---|
| 15-inch | 0.47 | 0.47 | 1.40 | 1.40 |
| 15-inch | 0.90 | 0.90 | 1.90 | 1.90 |
| 21-inch | 0.65 | 0.65 | 1.82 | 1.82 |
| 21-inch | 1.00 | 1.00 | 2.00 | 2.00 |

TABLE 4-continued

| | Tv/Td | Th/Td | Th/Tc | Tv/Tc |
|---|---|---|---|---|
| 25-inch | 0.69 | 0.69 | 1.82 | 1.82 |
| 25-inch | 1.04 | 1.04 | 2.00 | 2.00 |
| 29-inch | 0.77 | 0.77 | 2.00 | 2.00 |
| 29-inch | 1.13 | 1.13 | 2.21 | 2.21 |
| 28-inch | 0.71 | 0.71 | 1.70 | 1.70 |
| 28-inch | 1.06 | 1.06 | 1.93 | 1.93 |
| 32-inch | 0.71 | 0.71 | 1.64 | 1.64 |
| 32-inch | 1.06 | 1.06 | 1.86 | 1.86 |

Figure 4:
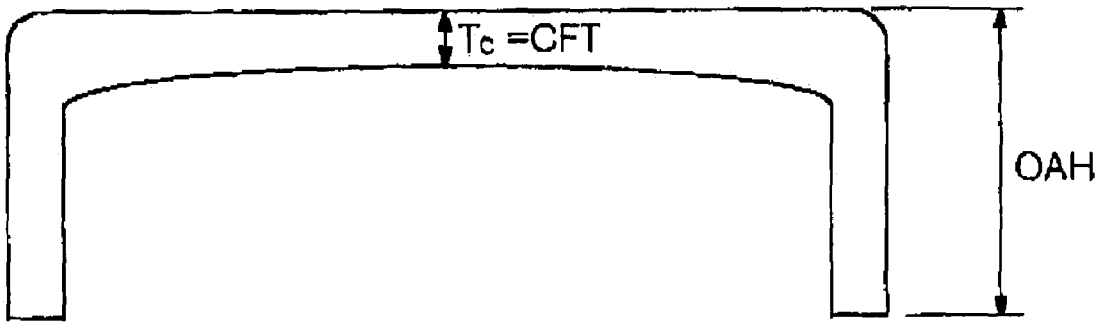
FIG. 4 is a diagram explaining thickness of the panel used in the cathode ray tube according to the present invention.

To explain with reference to Table 4, and FIGS. 3 and 4, Tv is thickness of vertical axis ending; Th is thickness of horizontal axis ending; Td is thickness of diagonal portion of the panel; and Tc is thickness of the panel's central portion. Here, if Tv/Td is below 0.47, Th/Td below 0.47, Th/Tc below 1.40, and Tv/Tc below 1.40, the curvature of the shadow mask is too small to maintain shadow mask strength.

In the meantime, if Tv/Td is greater than 1.13, Th/Td 1.13, Th/Tc 2.21, and Tv/Tc 2.21, the scanning distortion problem becomes more serious, especially when the electron beam is deflected. Moreover, the thickened panel lowers productivity and eventually results in an increase in costs.

For such reasons, it is preferable to have $0.47<Tv/Td\leqq 1.13$, $0.47\leqq Th/Td\leqq 1.13$, $1.40\leqq Th/Tc\leqq 2.21$, and $1.40\leqq Tv/Tc\leqq 2.21$.

Suppose that the distance from the panel center to the actual skirt edge portion is OAH. Then, as shown in Table 4, by shortening the distance from the panel's central thickness (CFT) and the panel center to the actual skirt edge portion (OAH), it is now possible to decrease weight of the panel in the conventional flat color cathode ray tube.

Accordingly, the panel price can be reduced due to the improved productivity in panel industries, and the light weight of the glass. Also, the total length of the cathode ray tube is relatively shorter than the length of the conventional flat Braun tube.

Further, the shortened skirt portion makes it possible to cut down band and frame, and thermal damages on the internal path can be greatly reduced.

However, if OAH/(USD/2) is below 0.18, problems such as increase in power consumption and deteriorated picture quality occur due to optic angle deflection. Also, if OAH/(USD/2) is greater than 0.29, there are few advantages over the conventional flat Braun tube.

Thus, it is preferable to have $0.18\leqq OAH(USD/2)\leqq 0.29$.

In conclusion, the cathode ray tube of the present invention is very advantageous in that the flat outer surface of the panel minimizes the distortion of images, and reproduces idealistic images, and the curved inner surface of the panel can prevent any deterioration of picture quality due to the doming phenomenon of the shadow mask made of AK material.

Moreover, the cost of the cathode ray tube of the present invention is as low as half the price of the conventional art, yet its panel is useful for the shadow mask made of AK material and has quality equivalent to the shadow mask made of Invar material.

Lastly, the cathode ray tube of the present invention results price competitiveness and improved productivity by utilizing the shadow mask made of low-price AK material.

While the invention has been described in conjunction with various embodiments, they are illustrative only. Accordingly, many alternative, modifications and variations will be apparent to persons skilled in the art in light of the foregoing detailed description. The foregoing description is intended to embrace all such alternatives and variations falling with the spirit and broad scope of the appended claims.

What is claimed is:

1. A cathode ray tube, comprising:

a glass panel at a front side;

a glass funnel at a rear side;

a fluorescent screen formed on an inner side of the panel;

a shadow mask disposed distant from the fluorescent screen by a designated space; and an electron gun emitting a beam disposed on a neck portion of the funnel opposing the fluorescent screen, wherein, an outer surface of the panel is substantially flat, and an inner surface of the panel has a curvature, and a transmittance ratio of an ending portion of an effective surface to a central portion of the panel is in the range of 0.4 to 0.6, and a radius of diagonal curvature (Rd) of the panel inner surface is in the range of 1.29R to 4.35R; and wherein, R=1.767×diagonal length of effective surface.

2. The cathode ray tube as claimed in claim 1, wherein a thickness of the panel's central portion (Tc) and a thickness of the panel's diagonal portion (Td) has a relation of $2.04 \leqq Td/Tc \leqq 2.50$.

3. The cathode ray tube as claimed in claim 1, wherein a transmittance of the panel's central portion is in the range of 40% to 75%.

4. The cathode ray tube as claimed in claim 1, wherein a ratio of the radius of diagonal curvature of the panel's inner surface to half of a diagonal length of the panel (USD/2) has a relation of $4.55 \leqq Rd/(USD/2) \leqq 10.68$.

5. The cathode ray tube as claimed in claim 1, wherein a ratio of a distance from a center of the panel to an actual skirt edge portion (OAH) to half of a diagonal length of the panel (USD/2) has a relation of $0.18 \leqq OAH/(USD/2) \leqq 0.29$.

6. The cathode ray tube of claim 1, wherein the shadow mask is made of aluminum killed (AK) material.

7. A cathode ray tube, comprising:

a glass panel at a front side;

a glass funnel at a rear side;

a fluorescent screen formed on an inner side of the panel;

a shadow mask disposed distant from the fluorescent screen by a designated space; and an electron gun for emitting a beam disposed on a neck portion of the funnel opposing the fluorescent screen, wherein, an outer surface of the panel is substantially flat, and an inner surface of the panel has a curvature, and given that a thickness of a central portion of the panel is Tc, and a thickness of a diagonal portion of the panel is Td, Td/Tc has a relation of $2.04 \leqq Td/Tc \leqq 2.50$, so that a desired curvature of the shadow mask made of AK material can be obtained.

8. The cathode ray tube as claimed in claim 7, wherein a thickness of the central portion of the panel (Tc) and a thickness of a vertical axis ending of the panel (Tv) has a relation of $1.40 \leqq Tv/Tc \leqq 2.21$.

9. The cathode ray tube as claimed in claim 7, wherein a thickness of the central portion of the panel (Tc) and a thickness of a horizontal axis ending of the panel (Th) has a relation of $1.40 \leqq Th/Tc \leqq 2.21$.

10. The cathode ray tube as claimed in claim 7, wherein a thickness of a diagonal portion of the panel (Td) and a thickness of a vertical axis ending of the panel (Tv) has a relation of $0.47 \leqq Tv/Td \leqq 1.13$.

11. The cathode ray tube as claimed in claim 7, wherein a thickness ratio of a diagonal portion of me panel (Td) and a thickness of a horizontal axis ending of the panel (Th) has a relation of $0.47 \leqq Th/Td \leqq 1.13$.

12. The cathode ray tube as claimed in claim 7, wherein a transmittance of a central portion of the panel is in the range of 40% to 75%, and a radius of diagonal curvature (Rd) of an inner surface of the panel is in the range of 1.29R to 4.35R, where R=1.767×a diagonal length of an effective surface.

13. The cathode ray tube as claimed in claim 7, wherein a transmittance ratio of a central portion of the panel to an ending portion of an effective surface is in the range of 0.4 to 0.6, and radius of diagonal curvature (Rd) of an inner surface of the panel is in the range of 1.29R to 4.35R, where R=1.767×a diagonal length of an effective surface.

14. The cathode ray tube as claimed in claim 7, wherein a radius of diagonal curvature (Rd) of an inner surface of the panel is in the range of 1.29R 4.35R, where R=1.767×a diagonal length of an effective surface, and a ratio of a radius of diagonal curvature of the panel's inner surface to half of a diagonal length of the panel (USD/2) has a relation of $4.55 \leqq Rd/(USD/2) \leqq 10.68$.

15. The cathode ray tube of claim 7, wherein the shadow mask is made of aluminum killed (AK) material.

16. A cathode ray tube, comprising:

a glass panel at a front side;

a glass funnel at a rear side;

a fluorescent screen formed on an inner side of the panel;

a shadow mask distant from the fluorescent screen by a designated space; and an electron gun for emitting a beam on a neck portion of the funnel that opposes the fluorescent screen, wherein, an outer surface of the panel is substantially flat, and an inner surface of the panel has a curvature, and transmittance of a central portion of the panel is in the range of 40% to 75%, and a radius of diagonal curvature (Rd) of an inner surface of the panel is in the range of 1.29R to 4.35R, where R=1.767×a diagonal length of an effective surface.

17. The cathode ray tube as claimed in claim 16, wherein a ratio of a radius of diagonal curvature of the panel's inner surface to half of a diagonal length of the panel (USD/2) has a relation of $4.55 \leqq Rd/(USD/2) \leqq 10.68$.

18. The cathode ray tube of claim 16, wherein the shadow mask is made of aluminum killed (AK) material.

19. A cathode ray tube, comprising:

a glass panel at a front side;

a glass funnel at a rear side;

a fluorescent screen formed on an inner side of the panel;

a shadow mask disposed distant from the fluorescent screen by a designated space; and an electron gun for emitting a beam on a neck portion of the funnel that opposes the fluorescent screen, wherein, an outer surface of the panel is substantially flat, and an inner surface of the panel has a curvature, and given that a radius of diagonal curvature of the inner surface of the panel is Rd and a diagonal length of the panel is USD, Rd is in the range of 1.29R to 4.35R, where R=1.767×a diagonal length of an effective surface, and a ratio of radius of diagonal curvature (Rd) of the panel's inner surface to half of the diagonal length of the panel (USD/2) has a relation of $4.55 \leqq Rd/(USD/2) \leqq 10.68$.

* * * * *